US005749128A

United States Patent [19]

Cuche

[11] Patent Number: 5,749,128

[45] Date of Patent: May 12, 1998

[54] EXTENSIBLE CLASP FOR A BRACELET

[75] Inventor: Cyril Cuche, Bienne, Switzerland

[73] Assignee: SMH Management Services AG, Biel, Switzerland

[21] Appl. No.: 806,641

[22] Filed: Feb. 26, 1997

[30] Foreign Application Priority Data

Mar. 8, 1996 [FR] France ..... 96 02975

[51] Int. Cl.[6] ..... A44C 5/00

[52] U.S. Cl. ..... 24/71 J; 24/69 J; 24/70 J; 24/265 WS

[58] Field of Search ..... 24/71 J, 70 R, 24/70 J, 69 J, 68 J, 265 WS, 583

[56] References Cited

U.S. PATENT DOCUMENTS

| | | | |
|---|---|---|---|
| 1,985,836 | 12/1934 | Prestinari | 24/71 |
| 2,069,559 | 2/1937 | Ritter | 24/71 J |
| 2,491,977 | 12/1949 | Heller | 24/71 |
| 2,532,840 | 12/1950 | Gaun | 24/71 J |
| 3,863,299 | 2/1975 | Hocq | 24/71 J |
| 4,928,359 | 5/1990 | Gagnebin | 24/71 |

FOREIGN PATENT DOCUMENTS

| | | | |
|---|---|---|---|
| 653226 | 12/1985 | Switzerland . | |
| 657 763 | 9/1986 | Switzerland . | |
| 667 979 | 11/1988 | Switzerland . | |
| 668 353 | 12/1988 | Switzerland . | |
| 1394776 | 5/1975 | United Kingdom | 24/71 J |

*Primary Examiner*—Victor N. Sakran

*Attorney, Agent, or Firm*—Griffin, Butler, Whisenhunt & Szipl

[57] ABSTRACT

The extensible bracelet clasp is of the unfolding buckle type. It includes a first assembly (1) comprising a cap (3) and a push-piece (5) adapted to slide on a second assembly (2) in order to adjust the length of the clasp. Such second assembly (2) comprises an arrangement (15) on which the push-piece (5) can act in order to open the clasp, such arrangement (15) and such push-piece being respectively provided with indexing means (16) and positioning means (17) in order to permit adjustment in length of the clasp and to retain the memory of such adjustment when the clasp is opened. The clasp can be used for a watch bracelet.

6 Claims, 5 Drawing Sheets

EXTENSIBLE CLASP FOR A BRACELET

The invention relates to an extensible clasp for a bracelet, in particular for a watch bracelet of the unfolding buckle type.

Clasps have already been proposed the length of which can be adjusted in the longitudinal direction of the bracelet, this being for the purpose of adapting at best the bracelet to the contour of the wrist which bears it.

BACKGROUND OF THE INVENTION

The patent document CH-A-667 979 describes a clasp including two assemblies hinged onto a curved blade and respectively secured to the first and second strands of the bracelet. One of the assemblies is attached to a central blade by means of a sliding articulation in order to permit easy adjustment of the length of the bracelet at the will of the user. The articulated assembly in question also comprises a latch hook fixed to a push-piece, such hook being adapted to fit into one of the openings provided in the central blade.

The patent document EP-A-0 350 785 describes a clasp including a first element bearing a hook and a second element under which is arranged a trigger. The second element is provided with an opening which allows two identical holes to appear arranged side by side in the longitudinal direction of the bracelet. The hook can be latched at choice in the first or the second hole according to whether a tight or looser winding of the bracelet around the wrist is desired.

The two documents which have just been cited are affected by a major drawback, that of losing the adjusted length each time that the clasp is opened. This thus necessitates searching once again the optimum length position each time the clasp is closed.

To overcome this drawback, there have been proposed clasps which preserve the adjustment of the length in memory when such clasps are open.

Thus, the patent document CH-A-653 226 proposes a clasp with an unfolding buckle exhibiting a base piece bearing a rack at its end on which an arm is hinged. One or the other of the rack spaces serves as support for pivots borne by the arm, which determines the length of the bracelet. Projecting hooks on the arm assure latching of the clasp by gripping the internal lateral faces of the base piece. This system, not having a push-piece for its length adjustment, gives rise to the drawback of necessitating opening the clasp in order to proceed with such adjustment which is going to necessitate several attempts in order to obtain a suitable adjustment.

The storage of the adjustment in length of the clasp is also evoked in the patent document CH-A-668 353. In this document the clasp with unfolding buckle comprises first and second segments adapted to fold back under a cover in the closed position. One of the bracelets strands is attached to an element including two opposed push-pieces adapted to slide in slideways. The push-pieces comprise hooks which are brought to catch on flanges borne by the first segment when the push-piece is in the closed position. One of the push-pieces further includes element positioning means, such means cooperating with indexing means borne by a cover shield, said means permitting modifying the length of the bracelet. If the principal embodiment of this clasp does not permit keeping in memory the length of the clasp when the latter is opened, one embodiment suggested as a variant attributes the blocking of the clasp to the first push-piece and to the second its adjustment in length. It will be understood that this manner of proceeding exhibits the drawback of having to recall the push-piece onto which it is necessary to act in order to effect one or the other of such functions, which is not necessarily self-evident.

To overcome the drawbacks affecting the clasps described in the cited documents, the clasp of the present invention enables keeping in memory the adjustment in length of the said clasp in making use of a single push-piece fulfilling at the same time the adjustment functions, the storing in memory of such adjustment and the opening of the clasp.

SUMMARY OF THE INVENTION

In order to attain this purpose, the extensible clasp of the present invention is noteworthy in the sense that it includes a first assembly comprising a cap to which is secured a first strand of the bracelet and a push-piece permitting the opening of the clasp and/or the adjustment of its length, said push-piece emerging from an opening formed in a side exhibited by the cap, and a second assembly on which the first assembly is adapted to slide in the longitudinal direction of the bracelet, such second assembly comprising first and second blades foldable back on one another and attached together at their first ends by means of an articulation, the first blade being provided with a hook while its second end is fitted with means permitting the securing of a second strand of the bracelet, the second blade being attached at its second end by an articulation to an arrangement to which the hook can attach so as to block the clasp, and on which arrangement the push-piece can act in order to open the clasp, said arrangement and said push-piece being respectively provided with indexing means and positioning means in order to permit the adjustment in length of the clasp and to retain in memory such adjustment when said clasp is opened.

The invention will now be understood upon reading the description given hereinafter by way of example and illustrated by the drawing in which:

BRIEF DESCRIPTION OF THE DRAWING

FIG. 6 is a cross-section in plan, the clasp being in its length-adjusting position, the push-piece being pressed in.

DESCRIPTION OF THE PREFERRED EMBODIMENT

Figure 1:
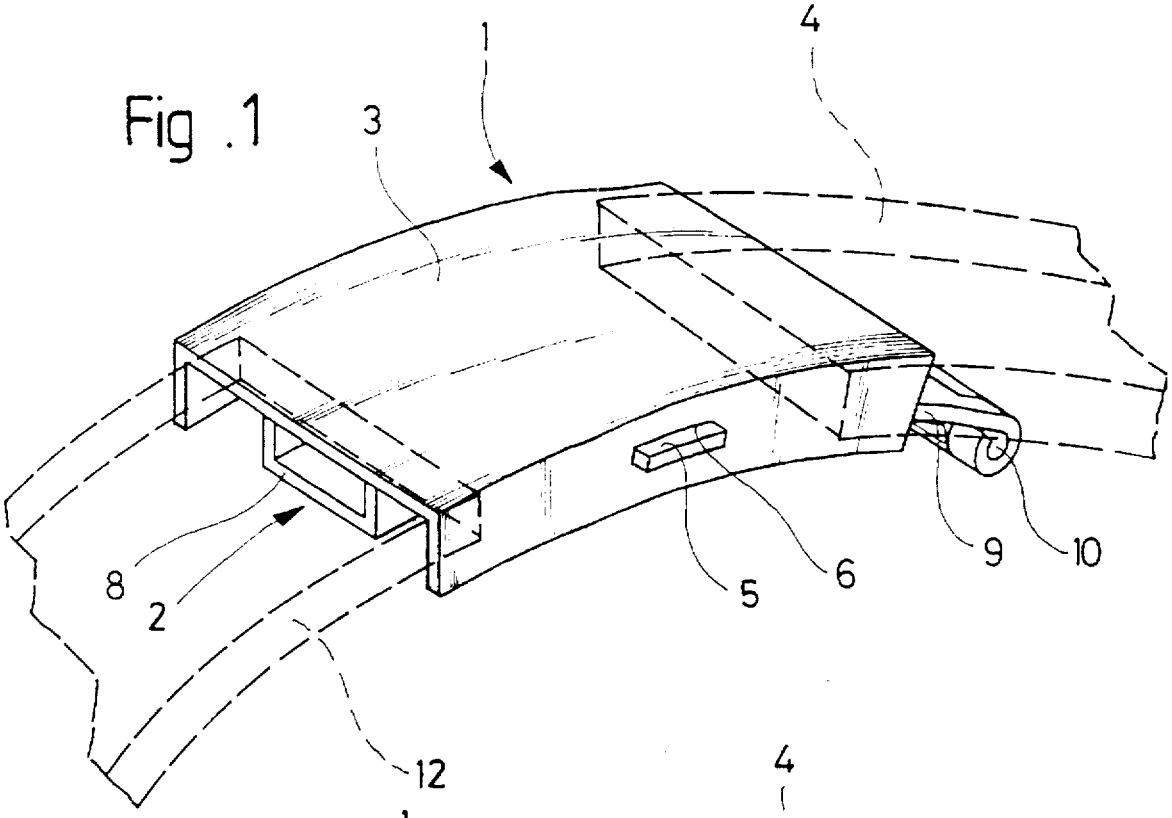
FIG. 1 is a perspective view of the clasp in closed position.
Figure 2:
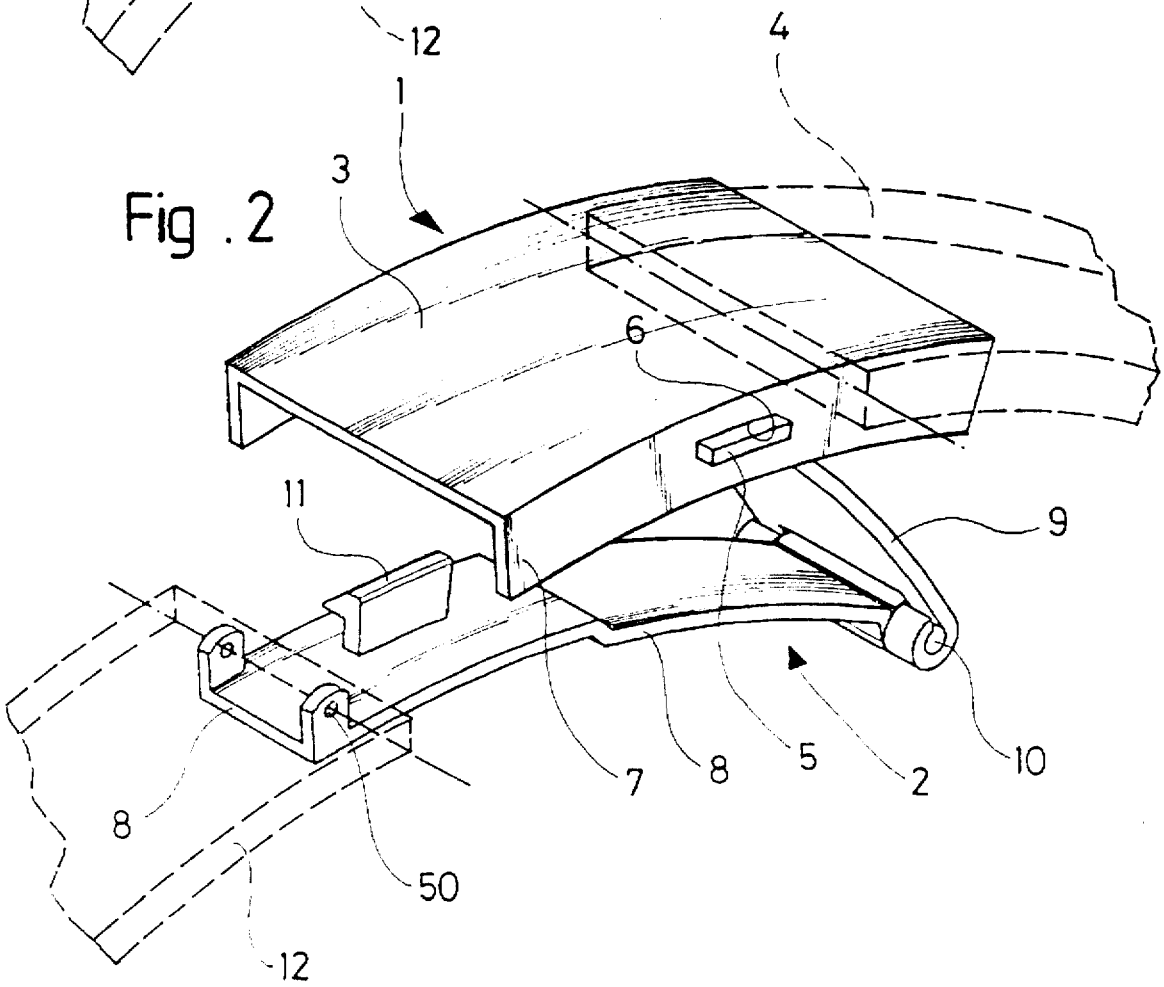
FIG. 2 is a perspective view of the clasp in open position.

FIGS. 1 and 2 are perspective views of the clasp of the invention, FIG. 1 showing such clasp in closed position and FIG. 2 in open position. This clasp is extensible and is of the unfolding buckle type like those which have been described hereinabove and which illustrate the prior art.

The clasp of the invention includes a first assembly 1 which comprises a cap 3 to which a first strand 4 of the bracelet is secured in a known manner, not illustrated in detail, such first strand being suggested here by dashed lines. The first assembly 1 also includes a push-piece 5 which emerges from an opening 6 formed in a side 7 which the cap 3 exhibits. The reader is here rendered attentive to the fact that the dimensions of the opening 6 are substantially equal to the dimensions of the cross-section of push-piece 5 so that the push-piece is drawn along by cap 3 when the latter is longitudinally displaced, such push-piece being capable of being moved only in a transversal direction. The push-piece permits, as will be explained further on, the opening of the clasp and/or the adjustment of its length.

The clasp of the invention further includes a second assembly 2 which is adapted to slide under the first assembly 1 in the longitudinal direction of the bracelet, as will be seen further on. FIGS. 1 and 2 as well as FIG. 3, which is a perspective view of this second assembly, show that the latter comprises first 8 and second 9 blades foldable back on one another, such blades being attached together at their first ends by means of an articulation 10. As is apparent on FIGS. 2 and 3, the first blade 8 is provided with a hook 11 and the second end of such first blade 8 is fitted with means 50 enabling the securing of a second strand 12 of the bracelet, here as well suggested by dashed lines. The securing means 50 are here illustrated by two lugs which will be supposed to be traversed by a pin in order to attach them to strand 12. As is visible on FIG. 3, the second blade 9 is attached at its second end by an articulation 13, 14 to an arrangement 15 which does not appear on FIGS. 1 and 2 hidden as it is by the cap 3. To such arrangement 15, readily visible on FIG. 3, the hook 11 can be anchored in order to block the clasp. In its widest sense, the arrangement 15 which constitutes the core of the present invention, is provided with indexing means 15 enabling positioning means 17 borne by the push-piece to adjust the clasp in length and to retain in memory such adjustment when said clasp is opened.

Figure 3:
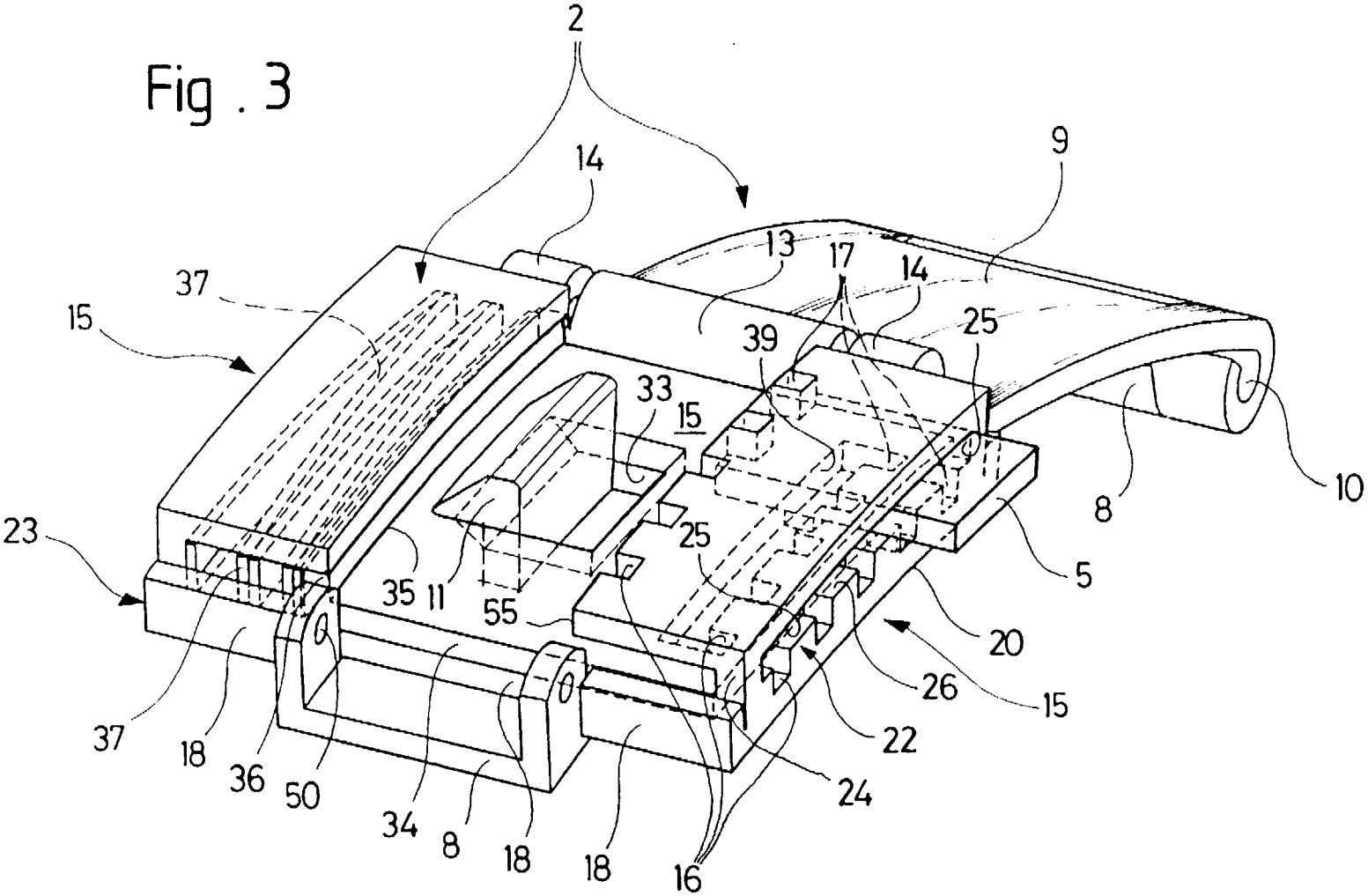
FIG. 3 is a perspective view of the parts mainly forming the second assembly of the clasp and a view of the push-piece acting on the arrangement enabling opening of said clasp as well as its setting in length, the cap of the clasp not being shown.
Figure 5:
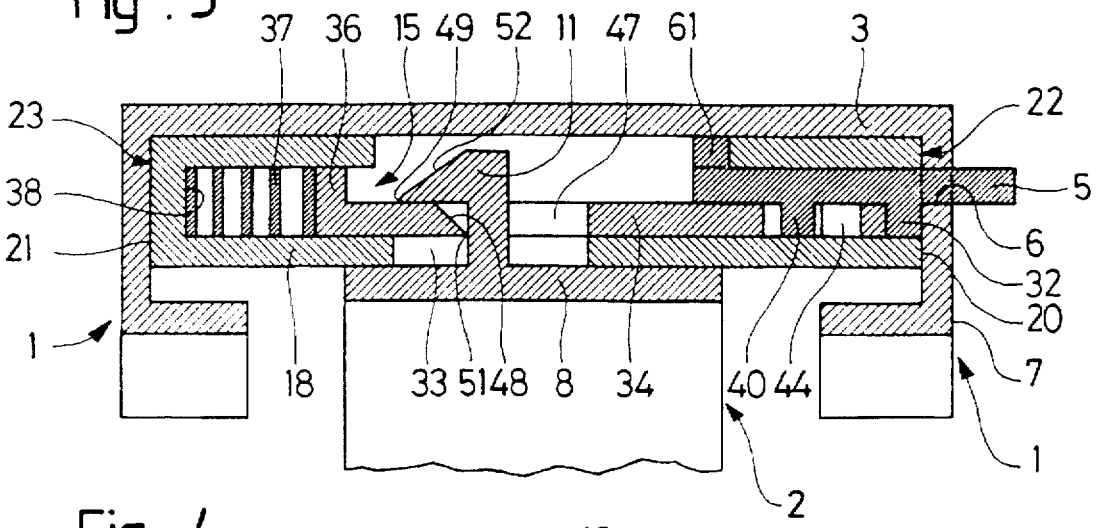
FIG. 5 is a cross-section according to line V—V of FIG. 4.
Figure 4:
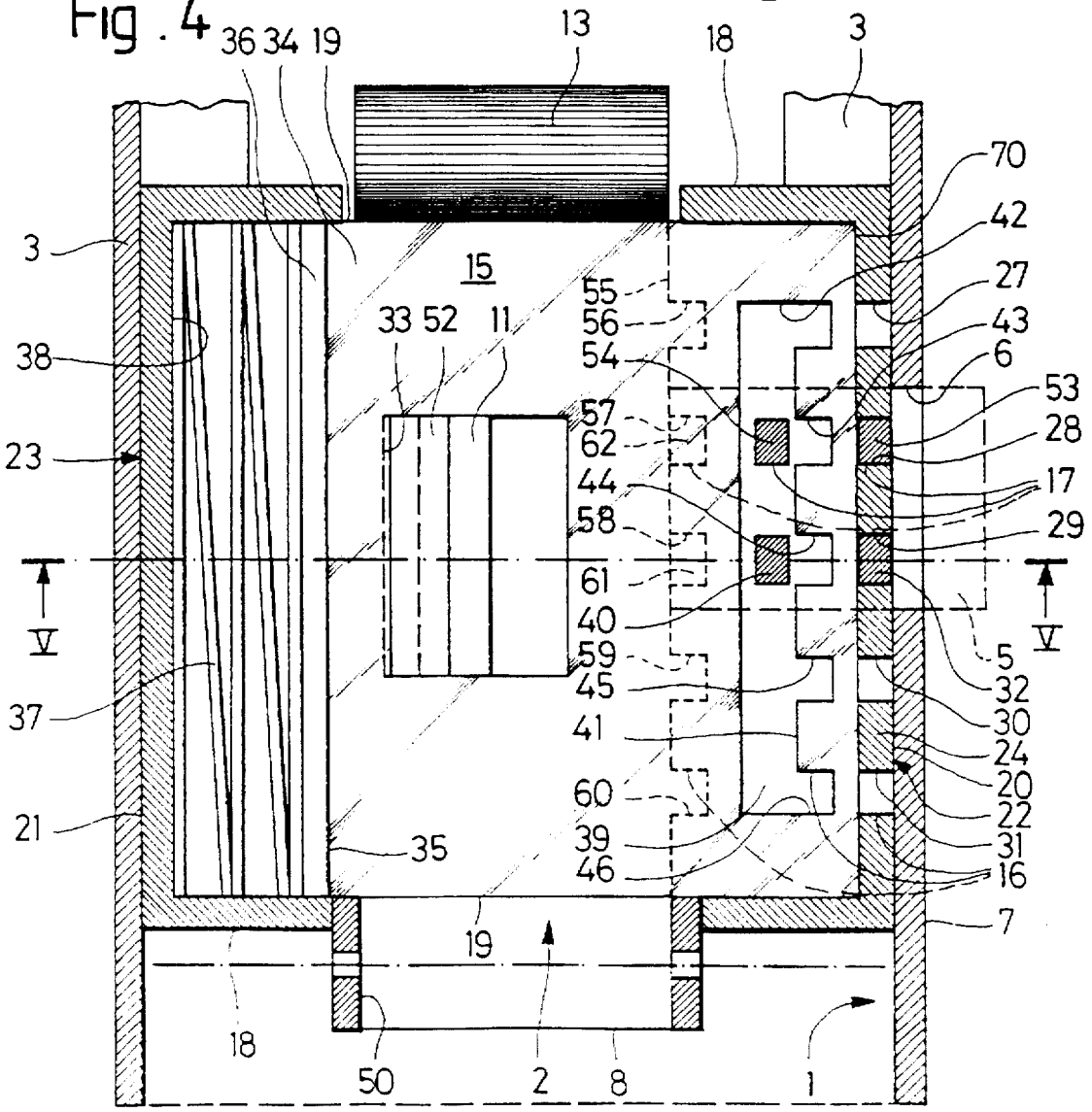
FIG. 4 is a cross-section in plan, the clasp being in closed position and the push-piece relaxed.

There will now be described, with the help of FIGS. 3, 4 and 5, a preferred embodiment of the invention. FIG. 3 shows only the second assembly 2 and the push-piece 5, the latter belonging to the first assembly 1, such push-piece being supposed to move transversally within opening 6 of the cap 3 (see FIGS. 1 and 2). FIG. 4 is a view cut in the plan of the clasp in which the first assembly 1 appears with its cap 3 and its push-piece 5 and in which the second assembly appears with its arrangement 15 and its first blade 8 to which are attached the securing means 50 of the second strand 12 (not shown) of the bracelet and the hook 11. FIG. 5 is a cross-section along line V—V of FIG. 4.

The arrangement 15 hinged to the second blade 9 of the assembly 2 includes a first rectangular plate 18. A transversal edge 19 of this first plate bears a hinge lug 13 on which the second blade 9 itself bearing two hinge lugs 14 is brought to articulate. The longitudinal edges 20 and 21 of the same first plate 18 are folded back in the form of a first U 22 and of a second U 23. The base 24 of the first U 22 is pierced by a rectangular slot 25 (see FIG. 3) traversed by the push-piece 5 which may be displaced longitudinally therealong, drawing with it the cap 3 to which it is connected. One of the elongated edges of slot 25 is provided with a plurality of notches 27 to 31. In one of such notches 29 can be transversally engaged at least a first stud 32 exhibited by push-piece 5. The first plate 18 is for the rest pierced by an opening 33 into which hook 11 can be introduced.

The arrangement 15 further includes a second rectangular plate 34 slidingly mounted transversally on the first plate 18. It will be noted that the transversal edges 19 of such first plate are partially raised squarely in order to prevent any longitudinal displacement of the second plate 34 relative to the first 18. One of the longitudinal edges of the second plate is raised in order to form a wall 36 against which bears the first end of a return spring 37, the second end of such spring bearing on the bottom 38 of the second U 23 of the first plate 18. The second plate 34 is also pierced by a rectangular slot 39 in which at least one second stud 40 exhibited by the push-piece 5 can move longitudinally. One of the elongated edges 41 of slot 39 is also provided with a plurality of notches 42 to 46. In one of such notches 44 the second stud 40 can be transversally engaged. Finally, the second plate 34 is pierced by an opening 47 into which the hook 11 can be introduced. One edge of this opening is cut in a bevel 48 along which a beak 49 exhibited by hook 11 can slide. To terminate, it will be observed that the notches of the arrangement 15 are the indexing means and the studs of push-piece 5 the positioning means of the arrangement studied, such means having been evoked hereinabove.

In the light of the description which has just been given of the various elements making up the clasp, its operation will now be explained.

FIGS. 4 and 5 show the clasp in the closed or blocked position. In such case the push-piece 5 is relaxed and the first stud 32 of said push-piece 5 is engaged in a notch 29 of the first plate 18 which determines the length of the clasp and thus prevents all displacement of the first assembly 1 relative to the second assembly 2. In this situation, the longitudinal edge 70 of the second plate 34 bears on the bottom of the first U 22 of the first plate 18, the spring 37 is relaxed and the bottom of the beak 49 of hook 11 bears on the second plate 34, thus blocking the clasp.

Figure 7:
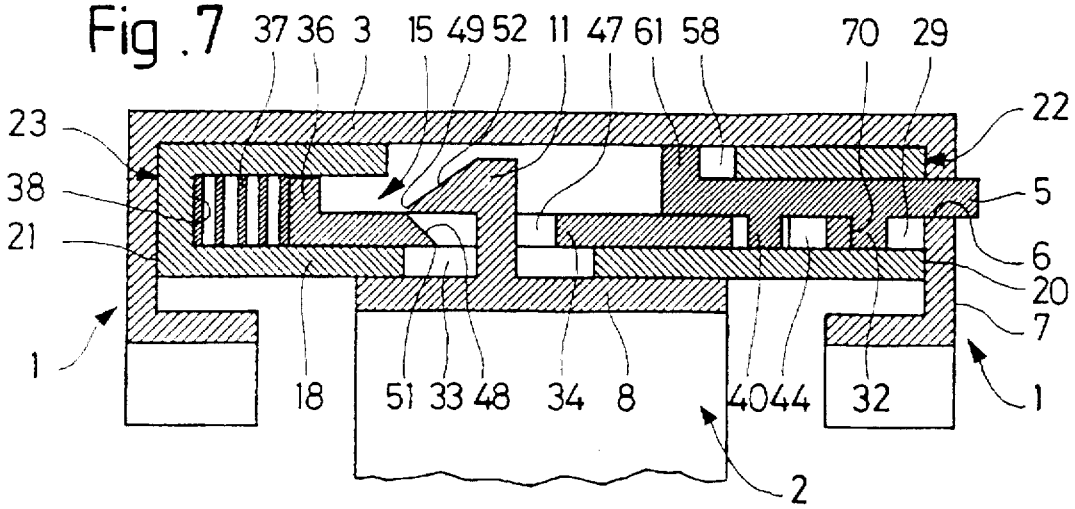
FIG. 7 is a cross-section according to line VII—VII of FIG. 6.
Figure 6:
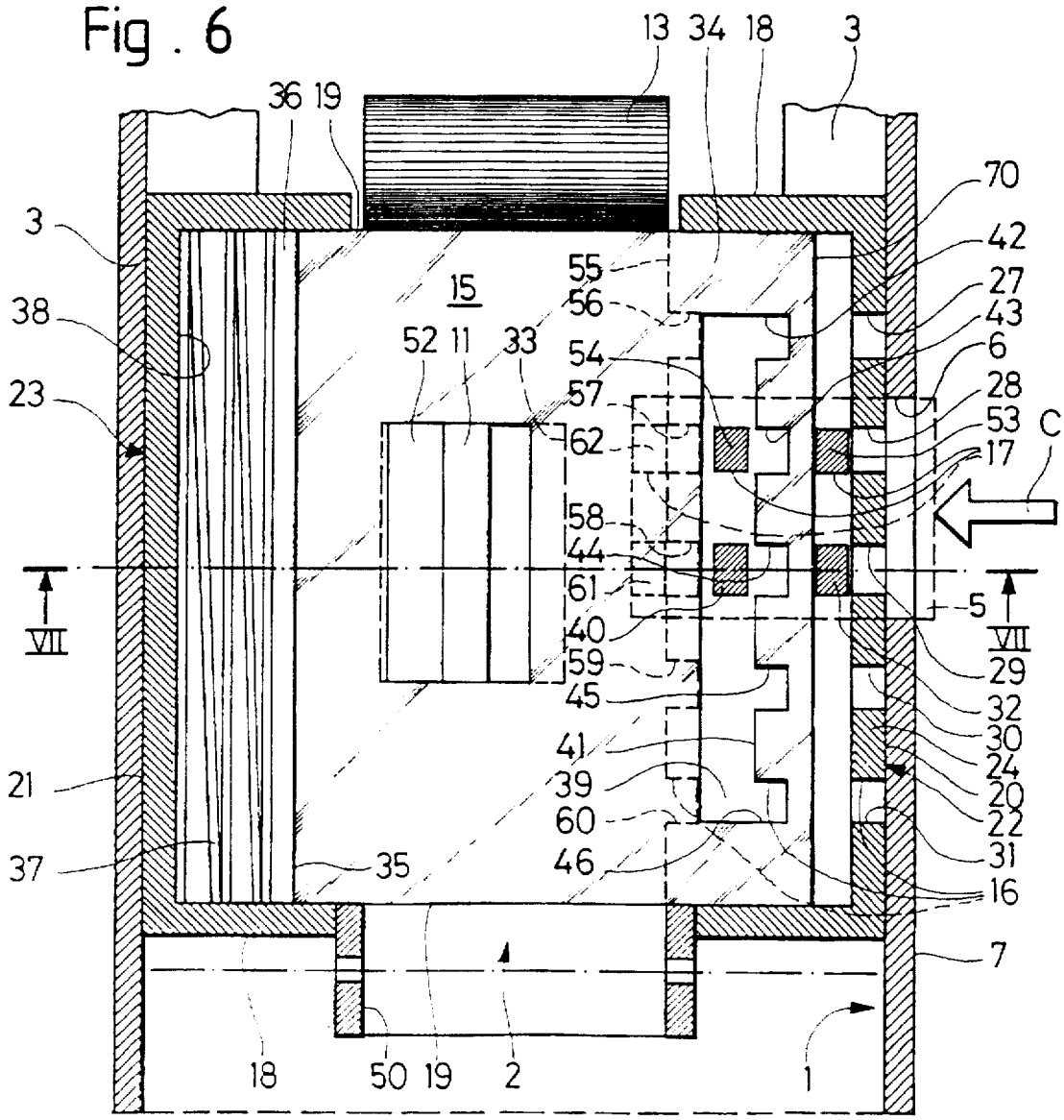

FIGS. 6 and 7 show the clasp in the length adjustment position. To accomplish this, one presses on the push-piece in the sense of arrow C, which disengages the first stud 32 of the push-piece 5 out of notch 29 of the first plate 18. At just this moment, the first assembly 1, that is to say, the cap 3 and push-piece 5 which it draws along can be displaced freely and longitudinally on the second assembly 2 and the first stud 32 can be brought for example opposite notch 28 in order to lengthen the clasp or brought, for example, opposite notch 30 to shorten the clasp. Once the adjustment has been chosen, the push-piece 5 is relaxed and the blocked position described with reference to FIGS. 4 and 5 is once again encountered. It will be noted that in the adjustment position illustrated by FIGS. 6 and 7, the first stud 32, acting on the longitudinal edge 70 of the second plate 34, has caused said second plate to slide towards the left of the figures, which initially compresses the spring 37 and brings beak 49 of hook 11 to the upper edge of the bevel 48 in opening 47 of plate 34. It is thus seen that, in this position the clasp is still in the closed condition, but that its length can be adapted to the wrist without having to open the clasp.

Figure 9:
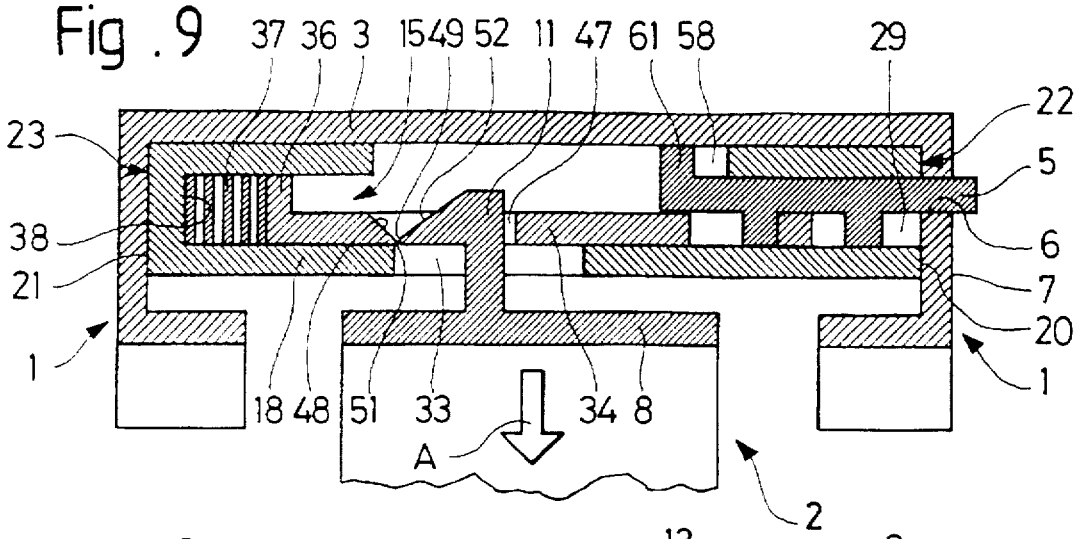
FIG. 9 is a cross-section according to line IX—IX of FIG. 8.
Figure 8:
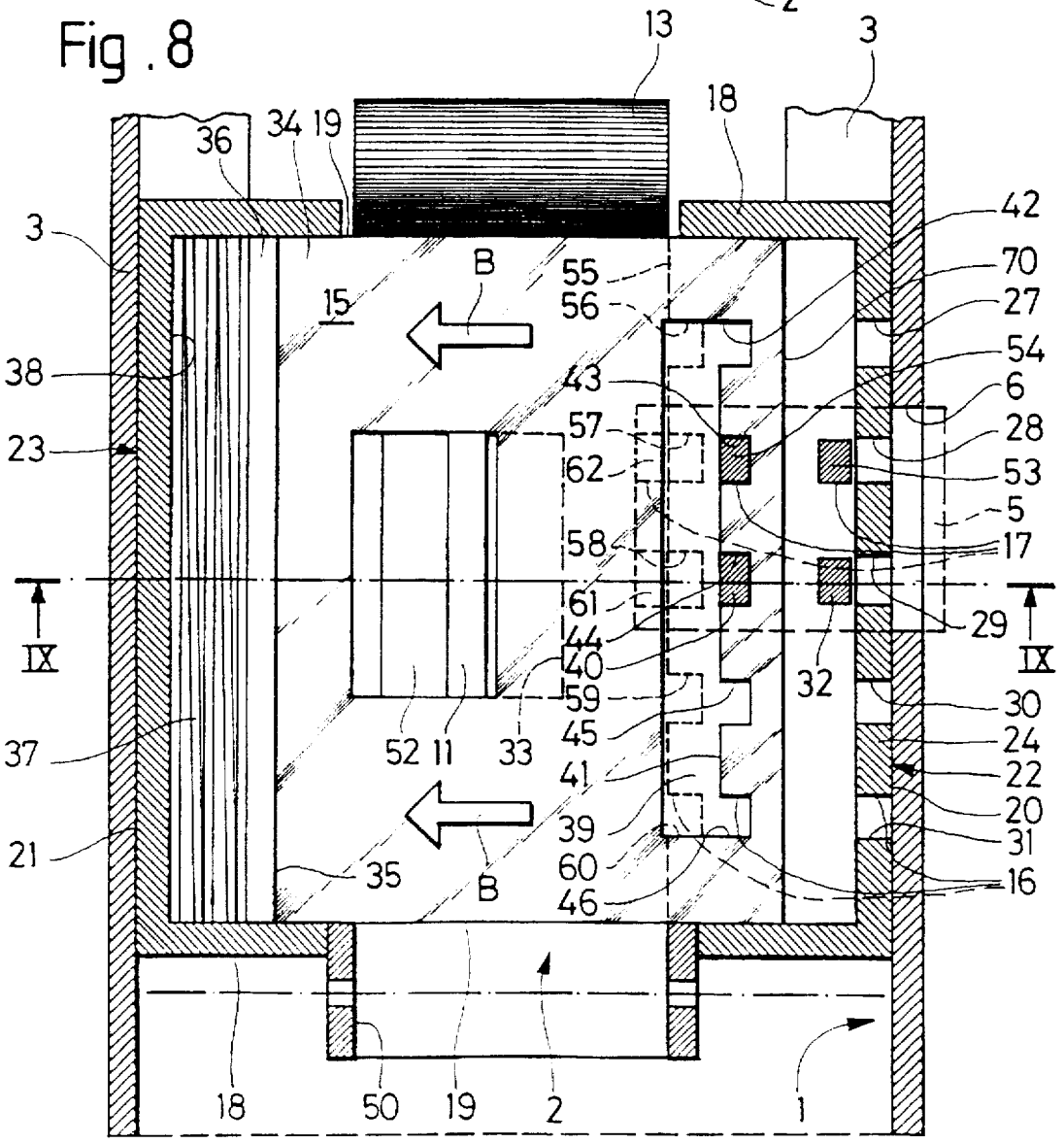
FIG. 8 is a cross-section in plan, the clasp being in the opening operation, the push-piece being pushed in or left free.

FIGS. 8 and 9 show the clasp during the opening operation and more precisely, at the end of such opening operation. In this case the push-piece 5 is pressed or simply left free and the first assembly 1 is lifted relative to the second in the sense indicated by arrow A. At this moment, beak 49 of the hook 11 has caused the second plate 34 to slide transversally in the sense of arrows B and this against the return force of spring 37 which is compressed still further. As is shown in particular by FIG. 8, the displacement of the second plate 34 has as consequence the engagement of the second stud 40 of the push-piece 5 in a notch 44 of said second plate. Since the second plate 34 cannot be moved in the longitudinal sense, it is then understood that during the entire opening operation the clasp cannot be adjusted in length since any longitudinal movement of the first assembly 1 relative to the second 2 is forbidden. It thus concerns the memorization of the position adjustment as was mentioned hereinabove and which preserves this position during opening of the clasp.

Should one continue to open the clasp from the position illustrated on FIG. 9, the hook 11 is entirely removed from openings 47 and 33 respectively exhibited by plates 34 and 18.

At this moment the second plate 34, pushed by spring 37, acts by its longitudinal edge 70 on stud 32 which then engages in notch 29 of the first plate 18, thus placing the push-piece 5 in the relaxed position (same position as that shown on FIGS. 4 and 5). Thus, in such open position the first assembly 1 is prevented from any movement relative to the second 2 and there likewise the memory of the adjustment position is preserved. It will be noted however that in such open position the first assembly can be displaced relative to the second if one presses push-piece 5 (position shown on FIGS. 6 and 7).

Finally, during the operation of closing the clasp, the push-piece 5 being left free (this operation not being illustrated by the figures), the lower end 51 of the bevelled edge 48 of opening 47 of the second plate 34 slides along a bevel 52 exhibited by the hook 11 (see for example FIG. 5 for these references). During such sliding, the second plate 34 slides transversally against the return force of spring 37 in a manner to engage a notch 44 of such second plate onto the second stud 40 of the push-piece 5 (same position as that presented on FIGS. 8 and 9) and to forbid all longitudinal movement of the first assembly 1 relative to the second 2, which preserves the memory of the position of adjustment. The end of the operation of closing is again illustrated by FIGS. 4 and 5 in which is shown the push-piece latched and prevented from moving longitudinally.

Thus, the final purpose of the invention has been brought about, namely permitting the adjustment in length of the clasp when the latter is still closed and preserving the memory of such adjustment when such clasp is blocked, open, during the operation of opening or in the operation of closing.

All explanations given hereinabove take into account a single first stud 32 and a single second stud 40 fitting out push-piece 5. All the figures however show that, preferably and this for reasons of stability, two first studs 32 and 53 adapted to be engaged in notches 27 to 31 of the first plate 18 and two second studs 40 and 54 adapted to be engaged in the notches 42 to 46 of the second plate 34 are used. In these conditions, if the notches on each of the plates are five in number, it is possible to adjust the clasp according to four different lengths.

Still for reasons of good operation and stability of the clasp, the figures show that the end 55 of first U 22 of the first plate 18 is provided with a plurality of notches 56 to 60 in which two third studs 61 and 62 exhibited by push-piece 5 are adapted to be engaged. It will be understood that such notches 56 to 60 and such third studs 61 and 62 play the same role as that explained with reference to notches 27 to 31 cooperating with the first studs 32 and 53.

The figures illustrating the invention make use of notches and studs in the form of parallelepipeds. Such notches and such studs could have another form, triangular for example, which to a certain degree could facilitate the penetration of the studs into the notches.

What I claim is:

1. An extensible clasp for a bracelet, in particular for a watch bracelet of an unfolding buckle type, including a first assembly comprising a cap to which is secured a first bracelet strand and a push-piece permitting opening of the clasp and an adjustment of a length of the clasp, said push-piece emerging from an opening formed in a side of the cap, and a second assembly on which the first assembly is adapted to slide in a longitudinal direction of the bracelet, such second assembly comprising first and second blades foldable back on one another and attached together at their first ends by an articulation, the first blade having a hook while its second end has a means for attaching to a second bracelet strand, the second blade being attached by an articulation at its second end to an arrangement which the hook can grasp so as to block the clasp, and on which the push-piece acts in order to open the clasp by allowing the first and second blades to be folded away from one another, said arrangement and said push-piece being respectively provided with indexing means and positioning means which release from and interengage with one another for permitting adjustment in length of the clasp and for retaining in memory such adjustment when said clasp is opened.

2. An extensible clasp as set forth in claim 1, wherein the arrangement attached to the second blade by the articulation includes a first rectangular plate one transversal edge of which bears a hinge lug to which said second blade is linked and the longitudinal edges of which are folded back in the form of a first and a second U, a base of the first U being pierced by a rectangular slot traversed by the push-piece which can be displaced along the length thereof, one of the elongated edges of said slot being provided with a plurality of notches for forming a first part of said indexing means of said arrangement in one notch of which at least a first stud forming a first part of said positioning means of the push-piece can transversely engage, said first rectangular plate being pierced by an opening into which the hook can be introduced, and a second rectangular plate slidingly mounted transversally on the first, one of longitudinal edges of the second plate being raised to form a wall against which bears a first end of a return spring, a second end of said return spring bearing on a bottom of the second U, the second plate being pierced by a rectangular slot within which at least one second stud forming a second part of said positioning means of the push-piece can be longitudinally moved, one of elongated edges of said slot being provided with a plurality of notches forming a second part of said indexing means of said arrangement in one of which said second stud can be transversally engaged, said second plate being pierced by an opening into which the hook can be introduced, an edge of said opening exhibiting a bevel along which a beak of the hook can slide.

3. An extensible clasp as set forth in claim 2, in which when in a closed position the push-piece is relaxed and the first stud is engaged in a notch of the first plate so as to determine the length of the clasp; when in position for adjustment of length, the push-piece is depressed and the first stud is disengaged from the notch of the first plate which permits longitudinal displacement of the first assembly relative to the second assembly without opening the clasp; when undergoing opening the push-piece is depressed and the beak of the hook causes the second plate to slide transversally against the return force of the return spring so as to engage one of its notches on the second stud and to prevent any longitudinal movement of the first assembly relative to the second; when in the open position the push-piece is relaxed and the first stud is engaged in a notch of the first plate preventing any longitudinal movement of the first assembly relative to the second; and when undergoing closing the push-piece is left free and a lower end of the bevelled edge of the opening of the second plate slides along a bevel of the hook and causes said second plate to slide transversally against the return force of the return spring so as to engage one of its notches on the second stud and to prevent all longitudinal movement of the first assembly relative to the second.

4. An extensible clasp as set forth in claim 2, wherein the push-piece includes two first studs for forming said first part of said positioning means of said push piece for engaging in the notches of the first plate and two second studs for forming said second part of said positioning means for engaging in the notches of the second plate.

5. An extensible clasp as set forth in claim 4, wherein a free end of the first U of the first plate is provided with a plurality of notches for forming a third part of said indexing means of said arrangement within which two third studs for forming a third part of said positioning means of the push-piece are adapted to be engaged.

6. An extensible clasp as set forth in claim 4, wherein each of the first and second plates has five notches thus enabling a choice of four different lengths of the clasp.

* * * * *